US006974149B2

(12) United States Patent
Naito et al.

(10) Patent No.: US 6,974,149 B2
(45) Date of Patent: Dec. 13, 2005

(54) BINDING FOR SNOWBOARD

(75) Inventors: Hideyuki Naito, Tokyo (JP); Tosiaki Satou, Tokyo (JP); Yosinori Uchie, Tokyo (JP)

(73) Assignee: Carmate Mfg. Co., Ltd., Tokyo (JP)

( * ) Notice: Subject to any disclaimer, the term of this patent is extended or adjusted under 35 U.S.C. 154(b) by 0 days.

(21) Appl. No.: 10/167,615

(22) Filed: Jun. 13, 2002

(65) Prior Publication Data

US 2002/0190502 A1 Dec. 19, 2002

(30) Foreign Application Priority Data

Jun. 14, 2001 (JP) ..... P. 2001-179623

(51) Int. Cl.[7] ..... A63C 5/00; A63C 9/02
(52) U.S. Cl. ..... 280/611; 280/623; 280/14.22
(58) Field of Search ..... 280/607, 611, 617, 280/618, 623, 624, 626, 629, 633, 634, 619, 280/14.21, 14.22, 14.24; 36/50.5, 58.5, 58.6, 36/117.1, 117.2, 117.7, 122, 125; 16/2.1, 16/2.2, 2.3, 2.4, 2.5; 403/92, 93, 96, 97, 99; 411/123, 124

(56) References Cited

U.S. PATENT DOCUMENTS

| | | | | | |
|---|---|---|---|---|---|
| 360,561 | A | * | 4/1887 | Clow | 403/97 |
| 1,527,915 | A | * | 2/1925 | Phelan | 411/136 |
| 3,852,943 | A | * | 12/1974 | Healy | 24/134 R |
| 4,856,810 | A | * | 8/1989 | Smith | 280/639 |
| 4,938,644 | A | * | 7/1990 | Runels | 411/132 |
| 5,143,396 | A | * | 9/1992 | Shaanan et al. | 280/607 |
| 5,758,895 | A | * | 6/1998 | Bumgarner | 280/607 |
| 5,901,975 | A | * | 5/1999 | Phipps | 280/618 |
| 6,061,870 | A | * | 5/2000 | Dodge et al. | 16/2.1 |
| 6,173,475 | B1 | * | 1/2001 | Senn et al. | 16/273 |
| 6,206,403 | B1 | * | 3/2001 | Black et al. | 280/618 |
| 6,390,492 | B1 | * | 5/2002 | Bumgarner et al. | 280/607 |
| 6,446,362 | B1 | * | 9/2002 | Martin et al. | 36/117.1 |
| 6,554,295 | B2 | * | 4/2003 | Rittmeyer | 280/11.3 |
| 6,581,944 | B1 | * | 6/2003 | Marmonier et al. | 280/14.22 |

FOREIGN PATENT DOCUMENTS

| | | | | |
|---|---|---|---|---|
| EP | 0 793 983 | * | 9/1997 | A63C 9/08 |
| JP | 09187543 | * | 7/1997 | A63C 9/02 |
| JP | 3076919 | | 7/1999 | |
| JP | 2000093571 A | * | 4/2000 | A63C 9/02 |
| JP | 3081397 | | 8/2001 | |
| JP | 3081398 | | 8/2001 | |
| WO | W9935412 | | 7/1999 | |

* cited by examiner

*Primary Examiner*—Christopher P. Ellis
*Assistant Examiner*—Bridget Avery
(74) *Attorney, Agent, or Firm*—R. Eugene Varndell, Jr.

(57) ABSTRACT

In a binding for a snowboard according to the invention, one band having one end mounted on the one-side rising portion of a base plate is connected to the other end of the other band having one end mounted on the other-side rising using a connecting member. A means for mounting the bands onto the rising portion is composed of a hole formed in the bands, a plurality of holes each having a hook groove respectively formed in the rising portion, a pin including a projection to be inserted into the hook groove, a lever disposed on the pin for rotating the pin, and an arc-shaped groove formed in a desired depth portion of each of the plurality of holes with a hook groove coaxially with the same hole and in communication with the hook groove.

20 Claims, 11 Drawing Sheets

BINDING FOR SNOWBOARD

BACKGROUND OF THE INVENTION

The present invention relates to a binding for a snowboard.

Now, FIG. 30 is an explanatory view of a conventional binding for a snowboard. In FIG. 30, reference numeral 1 designates a base plate to be fixed to a snowboard main body (not shown); 2: a boot; 3: a back support fixed to the rear end of the base plate 1 in such a manner that it can be contacted with the rear surface of the boot 2; 4: a cushion mounted on the inner surface of the back support 3; 5: an ankle strap disposed on the base plate 1 for fastening the instep of the boot 2; 6: ankle strap pad mounted on the inner surface of the ankle strap 5; 7: a toe strap disposed on the base plate 1 for fastening the tiptoe portion of the boot 2; and 8: a toe strap pad mounted on the inner surface of the toe strap 7, respectively.

Now, FIG. 31 is an explanatory detailed view of the toe strap 7. In FIG. 31, reference numeral 9*a* designates one band having one end thereof fixed to the one-side rising portion 10 of the base plate 1; 9*b*: the other band having one end thereof fixed to the other-side rising portion 10 of the base plate 1; 11: a buckle connected to the free end of the other band 9*b*; 12: a ratchet belt connected to the buckle 11; and 13: a lock part including a ratchet pawl for connecting the ratchet belt 12 to one band 9*a*.

By the way, the ankle strap 5 has the same structure as the toe strap 7.

In the thus structured binding for a snowboard, when mounting the boot 2 onto the base plate 1, the engagements between the ratchet belts 12 and lock parts 13 of the ankle strap 5 and toe strap 7 are removed, and one band 9*a* and the other band 9*b* are separated from each other by both hands. After then, the boot 2 is placed onto the base plate 1 from above thereof, the ratchet belt 12 is inserted into the lock part 13 including a ratchet bawl in such a manner as shown in FIGS. 31 and 32, and the buckle 11 is then fastened to thereby fix the instep portion and tiptoe portion of the boot 2 to the base plate 1.

In the binding of this type, in the rising portion 10 of the base plate 1, there are formed a plurality of holes which are used to fix one of the bands 9*a*, 9*b* such that the position thereof can be adjusted. That is, when adjusting the boot fixed state again, without removing the base plate from the snowboard, one of the bands is removed from its previously engaged one of the plurality of holes and is inserted into a new one of the plurality of holes to fix the boot to the base plate.

However, since the bands 9*a*, 9*b* and the rising portions 10 of the base plate 1 are fixed by bolts and nuts, a tool must be used to mount and remove them, which is troublesome.

Also, because the toe strap 7 is simply fastened from the upper portion of the tiptoe portion thereof, there is play in the tiptoe direction, so that the boot cannot be fastened sufficiently.

SUMMARY OF THE INVENTION

The present invention aims at eliminating the drawbacks found in the above binding for a snowboard.

In attaining the object, according to the first aspect of the present invention, there is provided a binding for a snowboard comprising: a base plate; one band mounted on a first side of the base plate; the other band mounted on a second side which is opposed to the first side of the base plate in a width direction thereof and connected together with the one band, the each band having one end with a first hole, which is mounted on the base plate; a pair of rising portions formed on the first and the second sides of the base plate for fixing the one end of the band, the pair of rising portions having a plurality of second holes each having a hook groove; and a pin adopted to be inserted into the second hole of the rising portion and the first hole of the band, the pin having a projection to be guided into the hook groove, wherein at least one of the band and the rising portion defines a apace for accommodating the projection of the pin.

It is preferable that the rising portion has a thin-wall part surrounding the second hole with the hook groove, and the space defined between the band and the thin-wall part accommodates the projection of the pin, the space being communicated with the hook groove.

It is preferable that the thin-wall part has the same thickness as a distance between the projection and a proximal end of the pin.

It is preferable that the pin is prevented from being removed from the second hole with the hook groove by rotated the pin after the pin is inserted into the second hole with the hook groove and the first hole of the band, so that the projection is accommodated within the space.

It is preferable that the space is a groove formed coaxially with the associated hole.

It is preferable that the groove is an arc-shaped groove.

It is preferable that the binding for a snowboard further comprises a lever attached to the pin for rotating the pin.

It is preferable that the binding for a snowboard further comprises a holding unit holding a lever of the pin at a desired rotational position.

It is preferable that the holding unit comprises a projected portion provided on the lever, and a hole formed in the rising portion in such a manner that the projected portion is fitted with the hole.

It is preferable that the holding unit comprises a projected surface formed in the rising portion in such a manner that the lever moves over the projected surface.

It is preferable that the two bands comprises one belt for fastening the leading end portion of the tiptoe portion of a boot and the other belt for fastening the upper portion of the tiptoe portion of the boot.

In attaining the object, according to the second aspect of the present invention, there is provided a binding for a snowboard comprising: a base plate; one band mounted on a first side of the base plate; the other band mounted on a second side which is opposed to the first side of the base plate in a width direction thereof and connected together with the one band, the each band having one end with a first hole, which is mounted on the base plate; a pair of rising portions formed on the first and the second sides of the base plate for fixing the one end of the band, the pair of rising portions having a plurality of second holes each having a hook groove; and a pin adopted to be inserted into the second hole of the rising portion and the first hole of the band, the pin having a projection to be guided into the hook groove, wherein the pin is prevented from being removed from the second hole with the hook groove by rotated the pin after the pin is inserted into the second hole with the hook groove and the first hole of the band, so that the projection is accommodated within the space.

DESCRIPTION OF THE PREFERRED EMBODIMENTS

Now, description will be given below of the preferred embodiments of a binding for a snowboard according to the invention with reference to the accompanying drawings.

Figure 1:
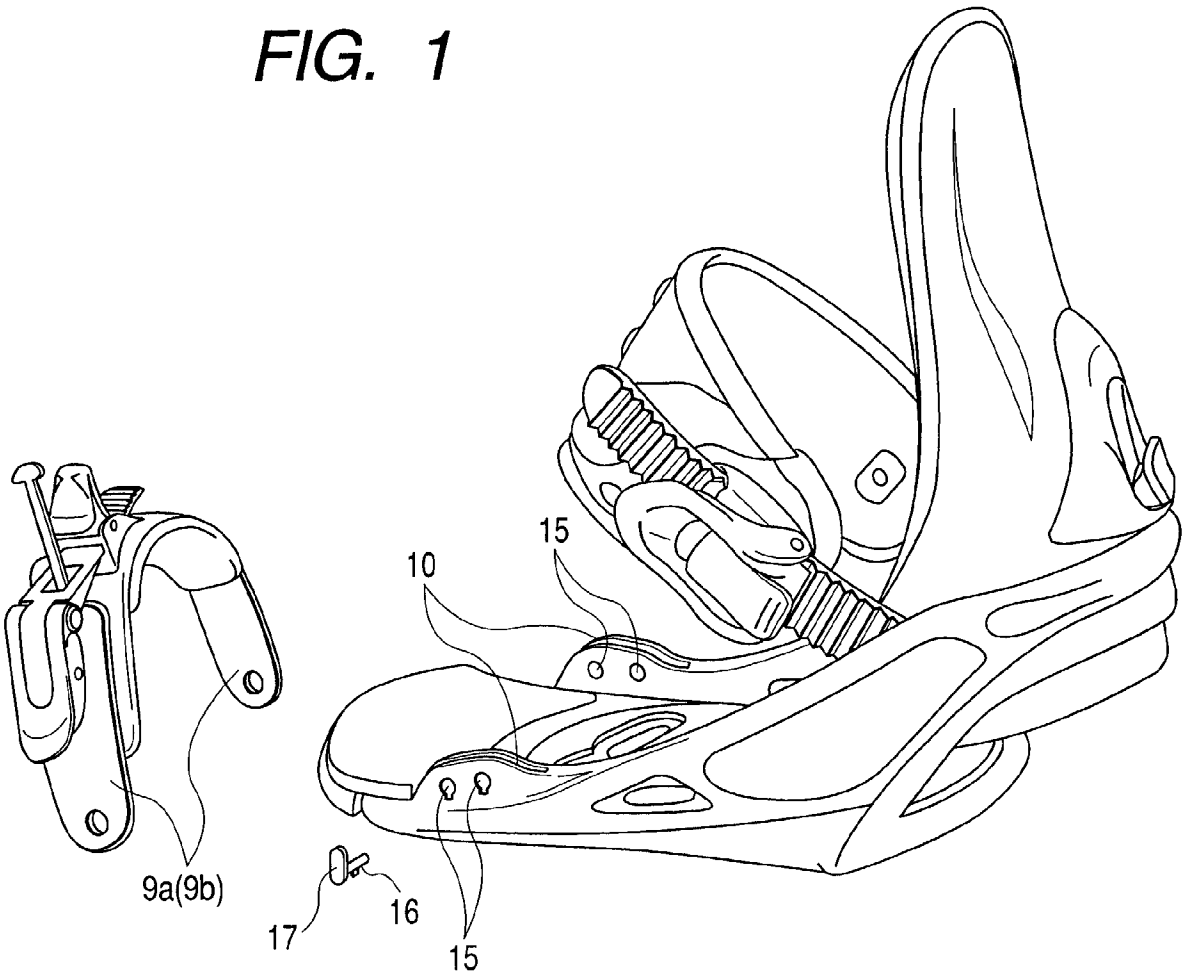
FIG. 1 is a perspective view of the binding for a snowboard of the invention.
Figure 2:
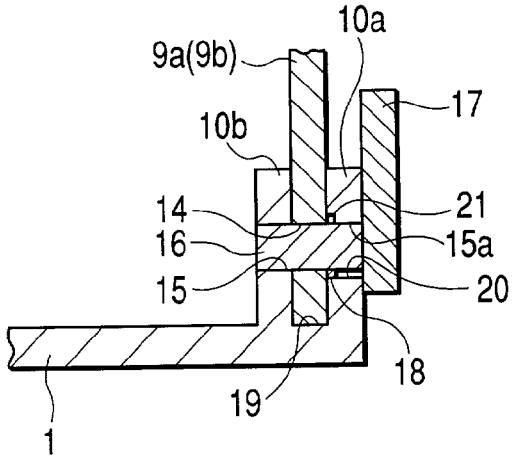
FIG. 2 is a longitudinal front view of a first embodiment of fixing means for fixing together bands and the rising portion of a base plate used a binding for a snowboard according to the invention.

In a binding for a snowboard according to the invention, as fixing means for fixing one of bands 9*a*, 9*b* of an ankle strap 5 and a toe strap 7 to the rising portion 10 of a base plate 1, instead of bolts and nuts, as shown in FIGS. 1 to 7, there is used a pin 16. FIG. 1 shows a perspective view of the binding for a snowboard of the invention. The pin 16 is inserted into a hole (first hole) 14 formed in one of the bands 9*a*, 9*b* as well as one of a plurality of holes (second holes) 15 formed in the rising portion 10 of the base plate 1. In addition, a lever 17 for rotating the pin 16 is fixed to the outer end of the pin 16 in such a manner that it is perpendicular to the pin 15.

In the rising portion 10 of the base plate 1 in which the hole 15 is formed, there is formed an insertion groove 19 which is used to insert the above band into the central portion of the upper end face of the rising portion 10; and, due to formation of the insertion groove 19, the rising portion 10 forks into outer and inner sections 10*a* and 10*b*. A hole to be formed in the outer section 10*a* of the forked rising portion 10 is formed as a hook-shaped hole (like key hole) 15*a* including a hook groove 20 formed in an inner surface thereof. On one side surface of the outer end portion of the pin 16, there is provided a projection 18 which corresponds to the hook groove 20. And, in an arbitrary depth portion of the hole 15*a*, there is concentrically formed an arc-shaped groove 21 which communicates with the hook groove 20 and corresponds to the projection 18 in length and width.

By the way, the groove 19 may be omitted. That is, the inner section of the forked shape of the rising portion 10 of the base plate 1 may not be formed.

Figure 3:
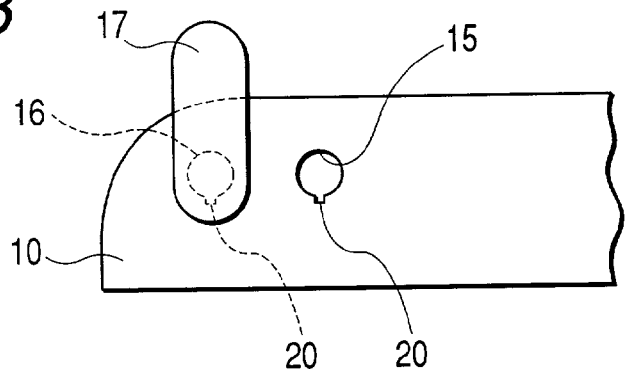
FIG. 3 is a side view of the bands and the rising portion of a base plate used in a binding for a snowboard according to the invention shown in FIG. 2.
Figure 4:
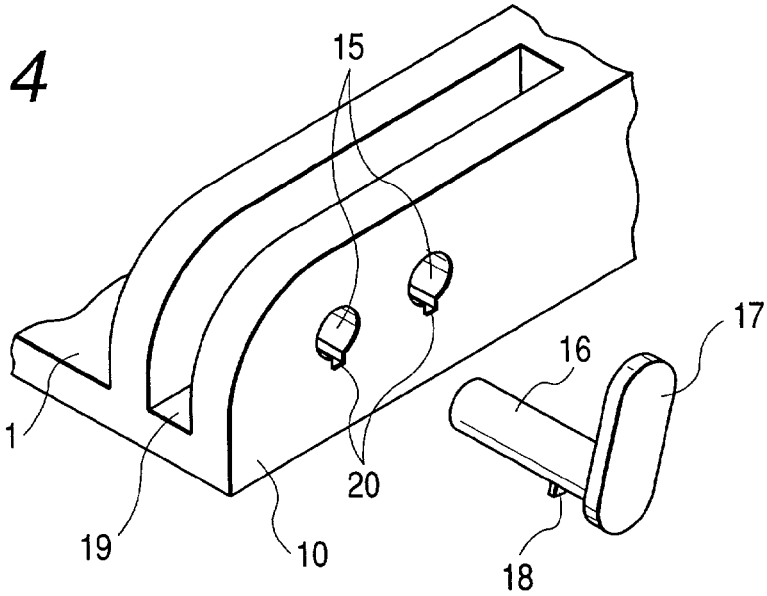
FIG. 4 is an explanatory view of the rising portion of the base plate of a binding for a snowboard according to the invention.
Figure 5:
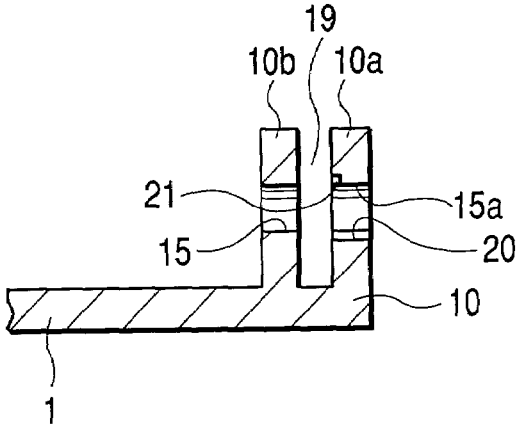
FIG. 5 is a longitudinal front view of the rising portion of the base plate of a binding for a snowboard according to the invention.
Figure 6:
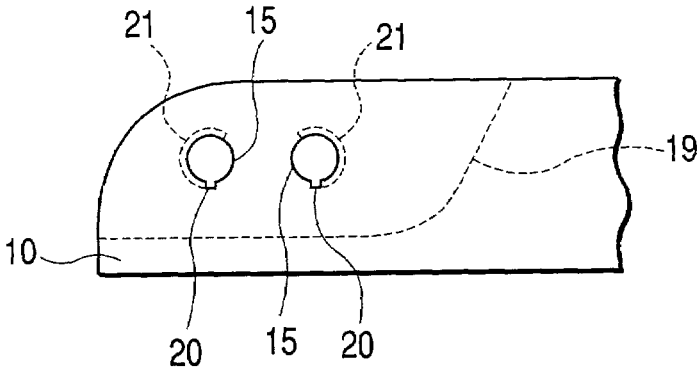
FIG. 6 is a side view of the rising portion of the base plate of a binding for a snowboard according to the invention.
Figure 7:
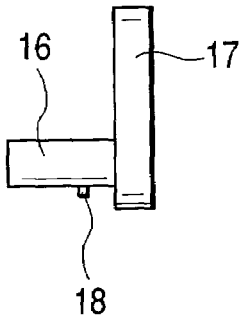
FIG. 7 is a front view of a pin and a lever used in a binding for a snowboard according to the invention.
Figure 8:
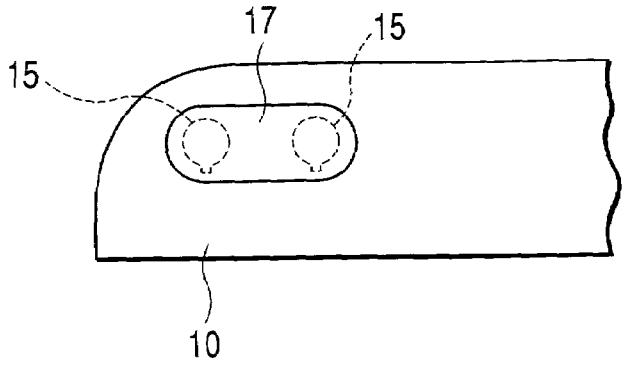
FIG. 8 is an explanatory side view of a modification of the first embodiment of the fixing means for fixing together the bands and the rising portion of the base plate used in a binding for a snowboard according to the invention.

Since a binding for a snowboard according to the invention is structured in the above-mentioned manner, as shown in FIG. 3, in case where the pin 16 of the lever 17 is inserted into the hole 15 of the rising portion 10 and the hole 14 of the band in a state where the projection 18 of the pin 16 is situated at a position corresponding to the hook groove 20 of the hook-shaped hole 15*a*. For example, in a state where the lever 17 stands erect, the projection 18 of the pin 16 is guided through the hook groove 20 up to the arc-shaped groove 21. In this state, as shown in FIG. 8, in case where the lever 17 is incliningly rotated clockwise, for example, by 90°, the projection 18 is allowed to move within the arc-shaped groove 21 to a position where the projection 18 is unable to return from the hook groove 20. Therefore, the pin 16 is prevented from removing from the hole 15, so that one of the bands 9*a*, 9*b* can be positively fixed to the base plate 1.

By the way, in case where the lever 17 is made to slidingly contact with the outer surface of the outer section 10*a* of the rising portion 10, and in a state where the projection 18 of the pin 16 is inserted into the arc-shaped groove 21, the lever 17 can be prevented from playing.

Figure 9:
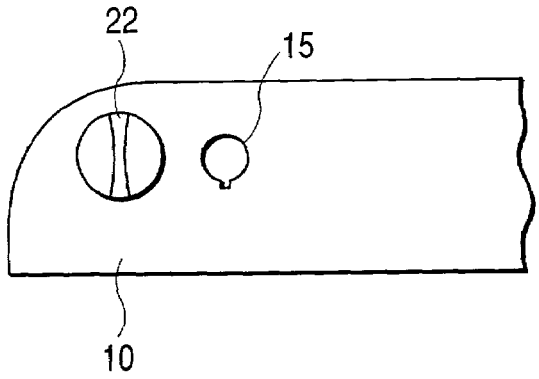
FIG. 9 is an explanatory side view of a second embodiment of the fixing means for fixing together the bands and the rising portion of a base plate in a binding for a snowboard according to the invention.
Figure 10:
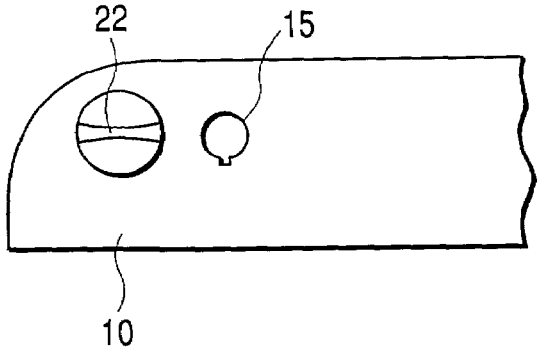
FIG. 10 is an explanatory side view of the fixing means shown in FIG. 9 in a binding for a snowboard according to the invention.

Also, as shown in FIGS. 9 and 10, instead of the lever 17, there may be used a circular-shaped knob part 22. That is, using the knob part 22, the pin 16 may be rotated.

Figure 11:
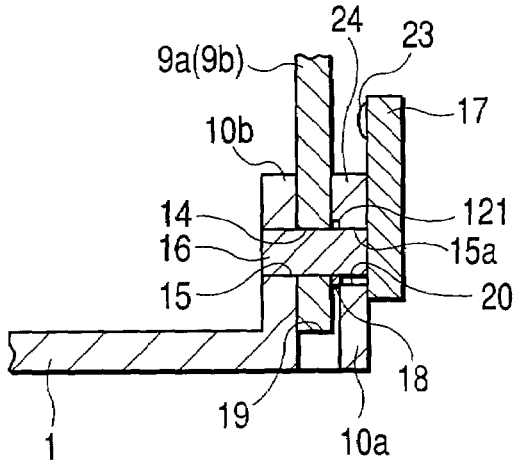
FIG. 11 is an explanatory side view of a third embodiment of fixing means used in a binding for a snowboard according to the invention.

Now, FIG. 11 shows a third embodiment of fixing means used in a binding for a snowboard according to the invention. In the present embodiment, on the side of the loose end portion of the lever 17 that is opposed to the outer surface of the outer section 10*a* of the rising portion 10, there is provided a projected portion 23. In addition to this, the band 9*a*(9*b*) and the rising portion 10*a* define a space 121 for accommodating a projected portion 18 of the pin 16. The rising portion 10*a* has a thin-wall part surrounding a hole 15*a* with the hook groove 20, and the space 121 defined between the band 9*a*(9*b*) and the thin-wall part accommodates the projected portion 18 of the pin 16, the space 121 being communicated with the hook grove.

Figure 12:
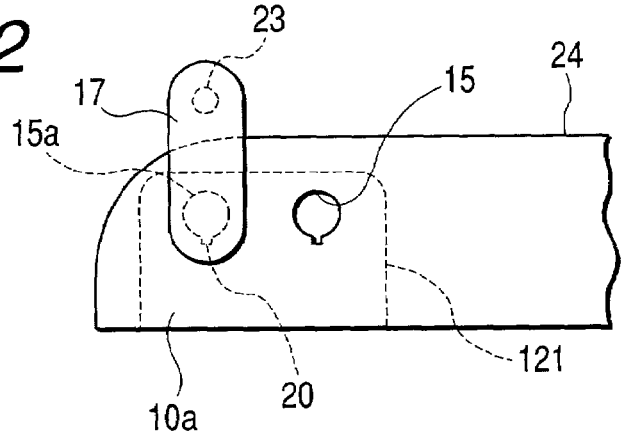
FIG. 12 is an explanatory side view of the fixing means shown in FIG. 11 in a binding for a snowboard according to the invention.
Figure 13:
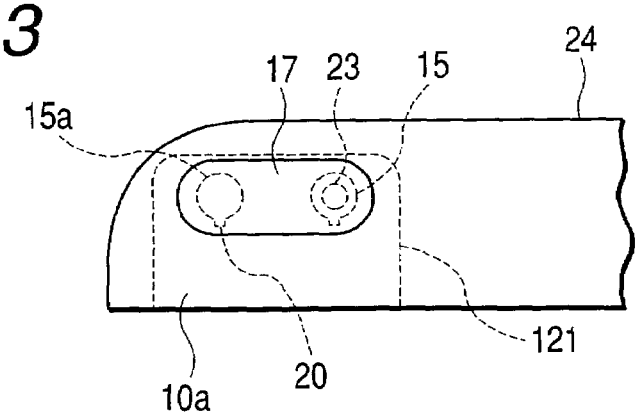
FIG. 13 is an explanatory side view of the fixing means shown in FIG. 11 in a binding for a snowboard according to the invention.

As shown in FIG. 12, in the position relation where the pin 16 and the projection 18 are inserted into the hole 15*a* and groove 20, the projected portion 23 is situated at a position beyond the end face 24 of the outer section 10*a* of the rising portion 10. And, in case where the lever 17 is incliningly turned clockwise from this position, as shown in FIG. 13, the projected portion 23 is moved up onto the end face 24 of the outer section 10*a* of the rising portion 10. After then, the lever 17 is flexed and is thereby slidingly contacted with the outer surface of the outer section 10*a*. For example, when the lever 17 is incliningly rotated by a given angle such as by 90°, the projected portion 23 may be fitted into the other hole 15 of the rising portion of the base plate 1. According to the present embodiment, there is eliminated a fear that the lever 17 can be rotated without good reason and the pin 16 can be removed from the hole 15 without good reason.

Figure 14:
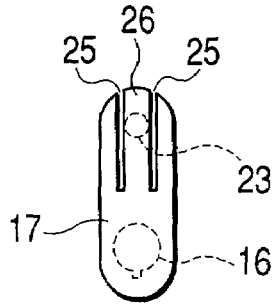
FIG. 14 is an explanatory side view of a modification of the third embodiment of fixing means used in a binding for a snowboard according to the invention.

By the way, as shown in FIG. 14, in the direction from the free end face of the lever 17 to the base portion thereof, there may be formed two slits 25 with the projected portion 23 between them to thereby facilitate the flexing of a lever portion 26 having the projected portion 23.

Figure 15:
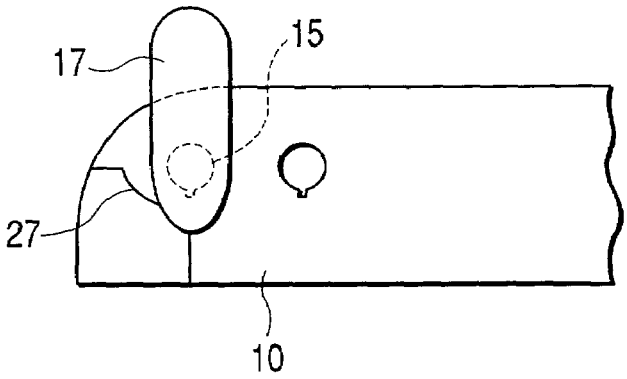
FIG. 15 is side view of a fourth embodiment of fixing means for fixing together bands and the rising portion of a base plate in a binding for a snowboard according to the invention.
Figure 16:
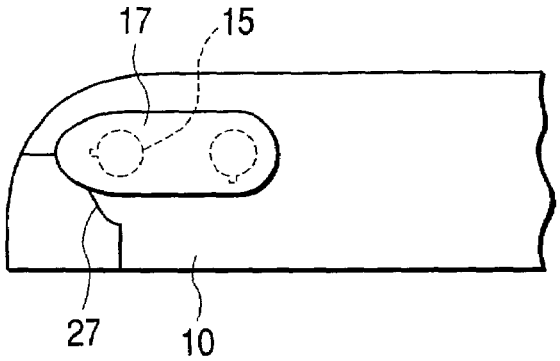
FIG. 16 is an explanatory side view of the fixing means shown in FIG. 15 in a binding for a snowboard according to the invention.

Now, FIGS. 15 and 16 show a fourth embodiment of fixing means used in a binding for a snowboard according to the invention. In the present, instead of the projected portion 23 provided in the third embodiment, there is provided a projected surface 27 in the outer surface of the outer section 10*a* of the rising portion 10. When the lever 17 is incliningly turned clockwise from its erect state shown in FIG. 15 by 90° into its another state shown in FIG. 16, the lower surface of the base end of the lever 17 may be situated at a position beyond the projected surface 27. According to the present embodiment, there is no possibility that the lever 17 can play counterclockwise, thereby being able to prevent the pin 16 from being removed from the hole 15 without good reason.

Figure 17:
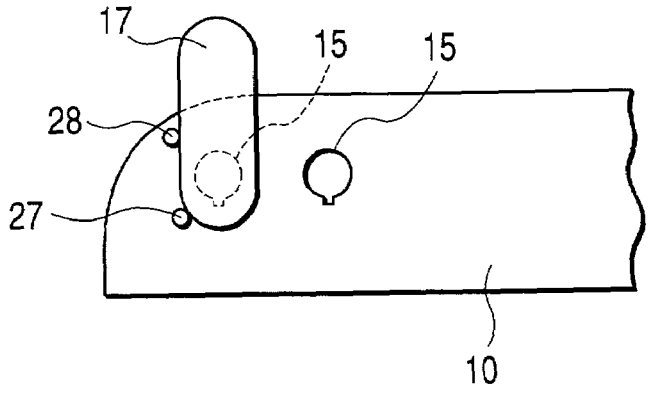
FIG. 17 is side view of a fifth embodiment of fixing means for fixing together the bands and the rising portion of a base plate in a binding for a snowboard according to the invention.
Figure 18:
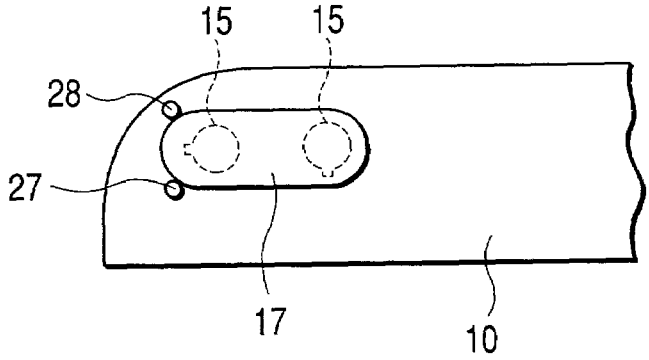
FIG. 18 is an explanatory side view of the fixing means shown in FIG. 17 in a binding for a snowboard according to the invention.
Figure 19:
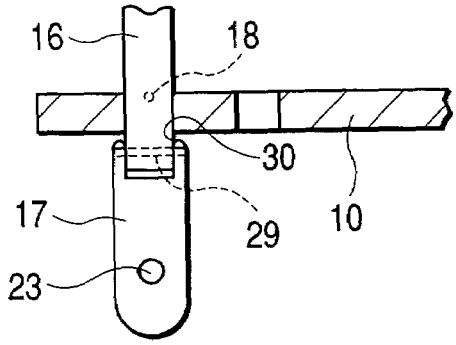
FIG. 19 is a transverse plan view of a sixth embodiment of fixing means used in a binding for a snowboard according to the invention.

By the way, the projected surface 27, as shown in FIGS. 17 and 18, may also be replaced with a pin 27. In this case, in order to prevent the lever 17 from rotating excessively clockwise from the state shown in FIG. 18, preferably, there may be provided a stop pin 28.

Figure 20:
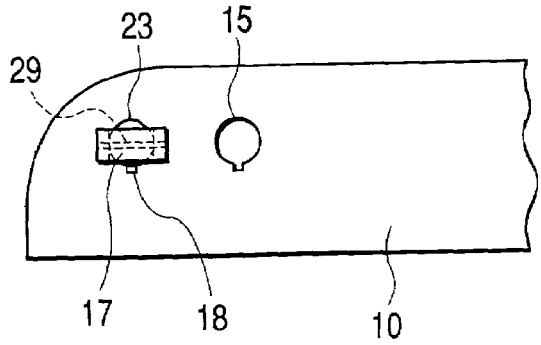
FIG. 20 is a side view of a lever shown in FIG. 19 in a binding for a snowboard according to the invention.
Figure 21:
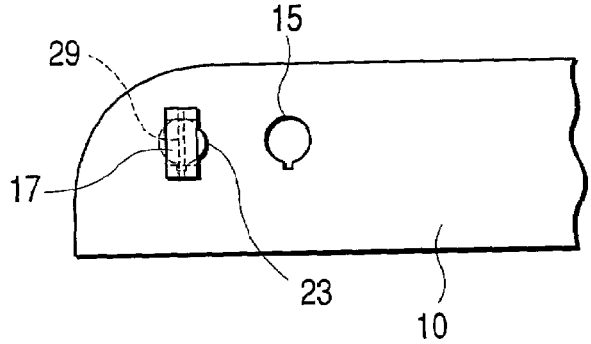
FIG. 21 is an explanatory side view of the lever shown in FIG. 19 in a binding for a snowboard according to the invention.
Figure 22:
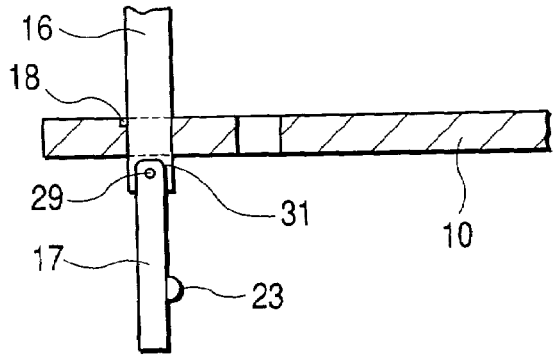
FIG. 22 is an explanatory transverse plan view of the lever shown in FIG. 19 in a binding for a snowboard according to the invention.
Figure 23:
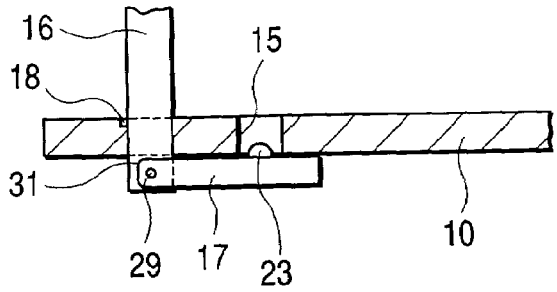
FIG. 23 is an explanatory transverse plan view of the lever shown in FIG. 19 in a binding for a snowboard according to the invention.

Now, FIGS. 19 to 23 show a fourth embodiment of fixing means used in a binding for a snowboard according to the invention. In the present embodiment, there is formed a groove 30 in the base end portion of the lever 17 to thereby turn the lever 17 into a Forked shape. The outer end portion of the pin 16 is inserted into the groove 30, and the lever 17 and pin 16 are pivotally supported through a pivot support pin 29 in such a manner that they can be incliningly rotated with respect to each other. And, in a state where, as shown in FIG. 20, the longitudinal-direction axis of the lever 17 is matched to the axis of the pin 16, the pin 16 is inserted into the hole 15 of the rising portion 10 and also into the hole 14 of the belts 9*a*, 9*b*. Then, as shown in FIGS. 21 and 22, the lever 17 is rotated clockwise by 90° about the axis of the pin 16. Next, as shown in FIG. 23, the lever 17 is incliningly rotated about the pivot support pin 29 by 90° with respect to the pin 16 to thereby fit the projected portion 23 into the other hole 15 in such a manner that the corner portion 31 of the forked end face of the lever 17 can be elastically engaged with the outer surface of the outer section 10*a* of the rising portion 10. According to the present embodiment, there is eliminated a fear that the lever 17 can be played with respect to the pin 16 without good reason and the pin 16 can be removed from the hole 15 without good reason.

In the embodiments shown in FIGS. 1 to 23, there are provided a pin having a projection and a plurality of holes having hook grooves and a arc-shaped grooves. However, a pin having a hook groove and a arc-shaped groove formed coaxially with the associated pin, and a plurality of holes each having a projection may be adopted into these embodiments of the present invention.

Figure 24:
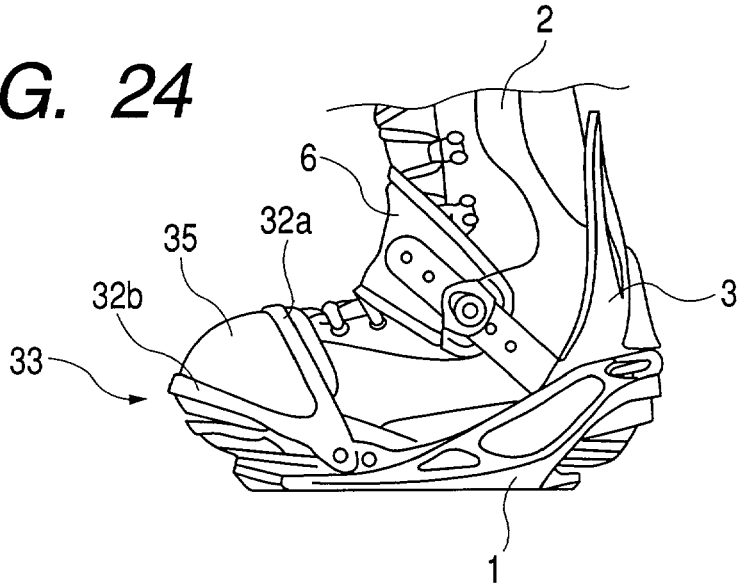
FIG. 24 is an explanatory side view of another embodiment of a binding for a snowboard according to the invention.
Figure 25:
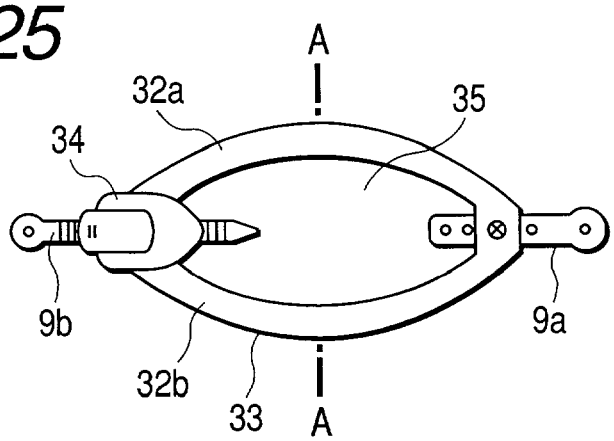
FIG. 25 is a plan view of the main portions of the binding for a snowboard according to the invention shown in FIG. 24.

Now, FIGS. 24 and 25 show a sixth embodiment of fixing means used in a binding for a snowboard according to the invention.

In the present, one end of a band 33 is fixed to the free end of one (for example, 9*a*) of the bands 9*a*, 9*b* of the conventional toe strap 7. One end of a band 33 is composed of one belt 32*a* for fastening the upper portion of the tiptoe portion of a boot and the other belt 32*b* for fastening the leading end portion of the tiptoe portion of the boot. On the other end of the band 33, a buckle 34 is mounted. One end of the band 9*b* is inserted into the buckle 34 to thereby fasten the band 33 and, at the same time, an expandable pad or a connecting member 35 is fixedly interposed between the belts 32*a* and 32*b*. The belts 32*a* and 32*b* may preferably be formed of the material that can be expanded and compressed to a slight degree.

In the present embodiment, the upper portion and leading end portion of the tiptoe portion of the boot can be fastened at the same time using one belt 32*a* and the other belt 32*b*.

Figure 26:
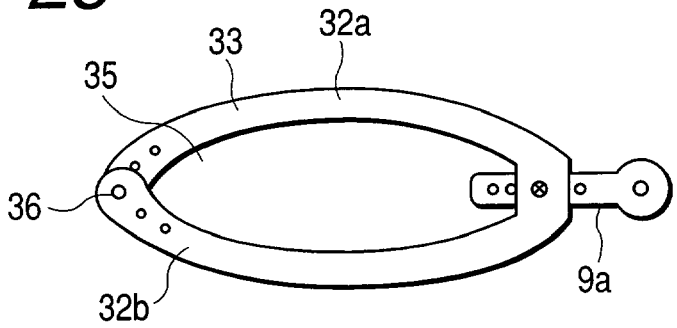
FIG. 26 is a plan view of a modification of the band shown in FIG. 25.
Figure 27:
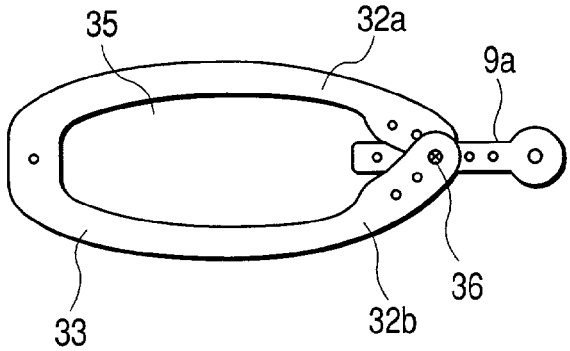
FIG. 27 is a plan view of another modification of the band shown in FIG. 25.

By the way, the two end portions of one belt 32*a* and the other belt 32*b* may be formed integrally with each other, or, as shown in FIGS. 26 and 27, one-side end portions of the belts 32*a* and 32*b* may be formed integrally with each other, while the other-side end portions thereof may be pivotally supported by a pin 36 in such a manner that they can be incliningly rotated with respect to each other.

Figure 28:
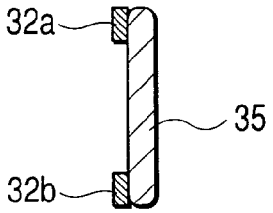
FIG. 28 is a section view taken along the line A—A shown in FIG. 25.
Figure 29:
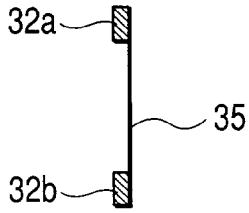
FIG. 29 is an explanatory view of a modification of a pad shown in FIG. 28.
Figure 30:
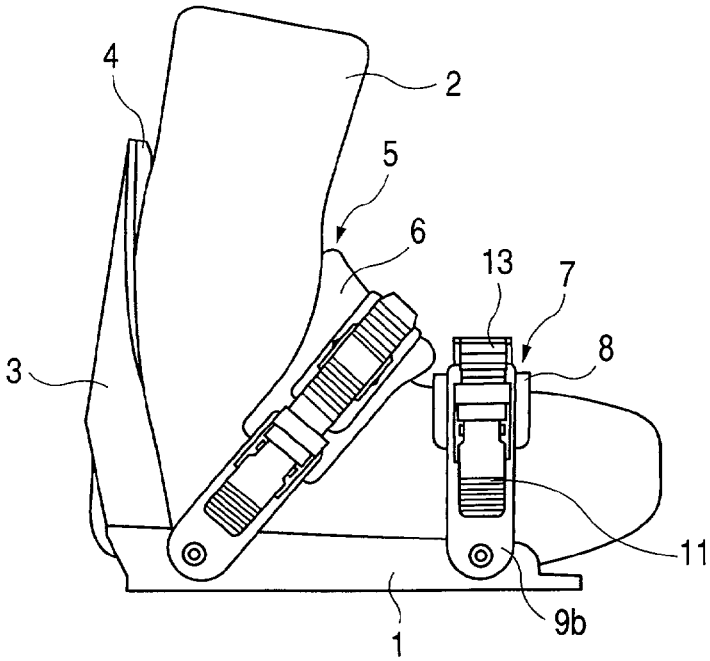
FIG. 30 is a side view of a conventional binding for a snowboard.
Figure 31:
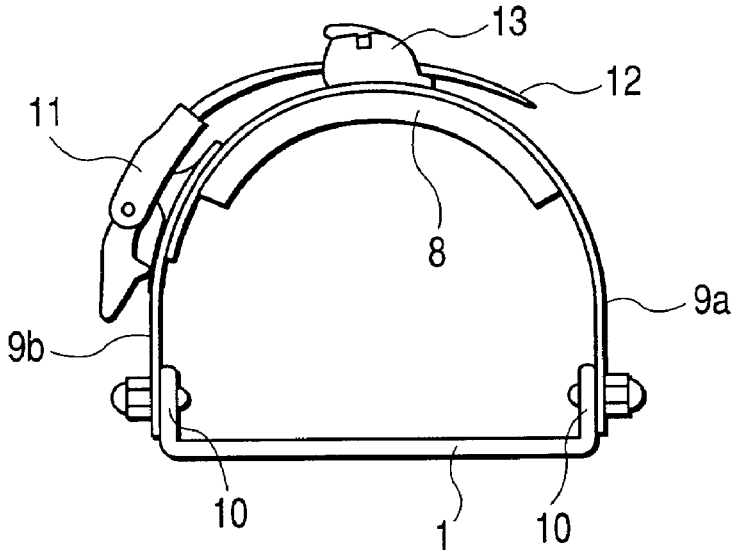
FIG. 31 is a front view of a conventional binding for a snowboard.
Figure 32:
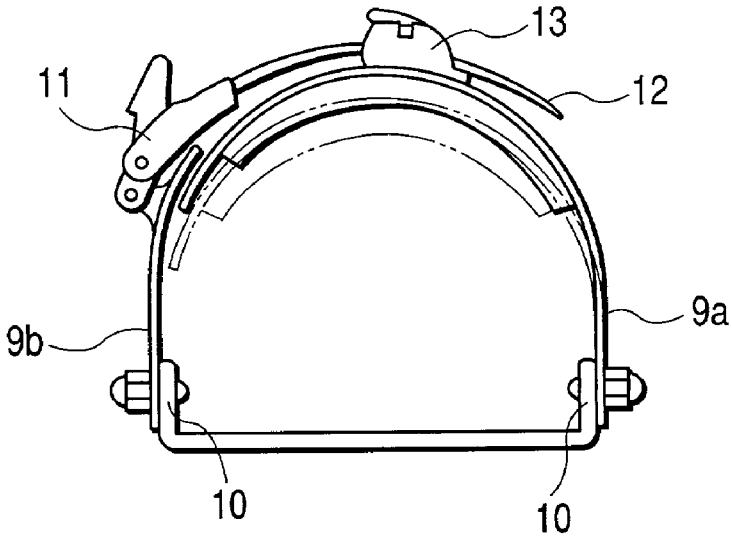
FIG. 32 is an explanatory front view of the conventional binding for a snowboard shown in FIG. 31.

Also, the connecting member 35, as shown in FIG. 28, may be formed of the material that is thick and has good cushioning, or, as shown in FIG. 29, it may be formed of the material that has good cushioning and is thin.

While only certain embodiments of the invention have been specifically described herein, it will apparent that numerous modifications may be made thereto without departing from the spirit and scope of the invention.

As has been described heretofore, in a binding for snowboard according to the invention, there can be provided a great advantage that the bands of the ankle strap and toe strap can be removed easily from the base plate without using-a tool.

Also, there can be obtained another great advantage that the upper portion and leading end portion of the tiptoe portion of the boot can be fastened at the same time and thus the boot can be fixed positively to the binding for a snowboard without producing any play in the tiptoe direction of the boot.

What is claimed is:

1. A binding for a snowboard comprising:

a base plate;

a first band mounted on a first side of the base plate;

a second band mounted on a second side which is opposed to the first side of the base plate in a width direction thereof and connected together with the first band, each band having an end with a first hole, which is mounted on the base plate;

a pair of rising portions formed on the first and the second sides of the base plate for fixing the ends of bands, the pair of rising portions having a plurality of second holes each having a hook groove, the hook grooves being formed lengthwise along an inner surface of respective second holes; and a pin adapted to be inserted into one of the plurality of second holes of the rising portions and the first hole of the band, the pin having a cylindrical structure with a smooth outer surface and a projection to be guided into the hook grooves, wherein at least one of the bands and the rising portions defines a space for receiving and holding the projection of the pin, so that at least one of the bands and the rising portions are pivotally joined together about the pin.

2. The binding for a snowboard as set forth in claim 1, wherein the rising portions have a thin-wall part surrounding the second holes with the hook grooves, and the space defined between the band and the thin-wall part accommodates the projection of the pin, the space being communicated with the hook grooves.

3. The binding for a snowboard as set forth in claim 1, wherein the pin is prevented from being removed from the second hole with the hook grooves by rotation of the pin after the pin is inserted into one of the second holes with the hook groove and the first hole of the band, so that the projection is accommodated within the space.

4. The binding for a snowboard as set forth in claim 1, wherein the hook groove is a channel formed along an inner surface of each of the plurality of second holes.

5. The binding for a snowboard as set forth in claim 1, wherein the projection guides the pin along and through the hook groove when the pin is being slid into one of the plurality of second holes.

6. The binding for a snowboard as set forth in claim 1, wherein at least one of the bands is locked to the base plate by rotation of the pin when inserted in the hole so that the projection is not aligned with the hook grooves.

7. The binding for a snowboard as set forth in claim 1, further comprising a lever attached to the pin for rotating the pin.

8. The binding for a snowboard as set forth in claim 2, wherein the thin-wall part has the same thickness as a distance between the projection and a proximal end of the pin.

9. The binding for a snowboard as set forth in claim 7, further comprising a holding unit holding a lever of the pin at a desired rotational position.

10. A binding for a snowboard comprising:

a base plate;

a first band mounted on a first side of the base plate;

a second band mounted on a second side which is opposed to the first side of the base plate in a width direction thereof and connected together with the first band, each band having an end with a first hole, which is mounted on the base plate;

a pair of rising portions formed on the first and the second sides of the base plate for fixing the ends of bands, the pair of rising portions having a plurality of second holes each having a hook groove; and a pin adapted to be inserted into one of the plurality of second holes of the rising portions and the first hole of the band, the pin having a projection to be guided into a hook groove, wherein at least one of the bands and the rising portions defines a groove formed coaxially with the associated hole for receiving and holding the projection of the pin, so that at least one of the bands and the rising portions are pivotally joined together about the pin.

11. The binding for a snowboard as set forth in claim 10, wherein the groove is an arc-shaped groove.

12. A binding for a snowboard comprising:

a base plate;

a first band mounted on a first side of the base plate;

a second band mounted on a second side which is opposed to the first side of the base plate in a width direction thereof and connected together with the first band, each band having an end with a first hole, which is mounted on the base plate;

a pair of rising portions formed on the first and the second sides of the base plate for fixing the ends of bands, the pair of rising portions having a plurality of second holes each having a hook groove;

a pin adapted to be inserted into one of the plurality of second holes of the rising portions and the first hole of the band, the pin having a projection to be guided into a hook groove; and a lever attached to the pin for rotating the pin;

wherein at least one of the bands and the rising portions defines the space is for receiving and holding the projection of the pin, so that at least one of the bands and the rising portions are pivotally joined together about the pin.

13. The binding for a snowboard as set forth in claim 12, further comprising a holding unit holding the lever of the pin at a desired rotational position.

14. The binding for a snowboard as set forth in claim 13, wherein the holding unit comprises a projected portion provided on the lever, and a hole formed in the rising portion in such a manner that the projected portion is fitted with the hole.

15. The binding for a snowboard as set forth in claim 13, wherein the holding unit comprises a projected surface formed in one of the rising portions in such a manner that the lever moves over the projected surface.

16. A binding for a snowboard comprising:

a base plate;

a first band mounted on a first side of the base plate;

a second band mounted on a second side which is opposed to the first side of the base plate in a width direction thereof and connected together with the first band, each band having an end with a first hole, which is mounted on the base plate, the two bands comprising one belt for fastening a leading end portion of a tiptoe portion of a boot and a second belt for fastening an upper portion of the tiptoe portion of the boot; and a pin adapted to be inserted into one of the plurality of second holes of the rising portions and the first hole of the band, the pin having a projection to be guided into a hook groove;

wherein at least one of the bands and the rising portions defines the space is for receiving and holding the projection of the pin, so that at least one of the bands and the rising portions are pivotally joined together about the pin.

17. The binding for a snowboard as set forth in claim 16, wherein the pin does not have threads.

18. The binding for a snowboard as set forth in claim 16, wherein the pin is not a bolt or screw and is not attached using a nut or threads.

19. The binding for a snowboard as set forth in claim 16, wherein at least one of the bands is locked to the base plate by rotation of the in pin when inserted in the hole so that the projection is not aligned with the groove.

20. A binding for a snowboard comprising:

a base plate;

a first band mounted on a first side of the base plate;

a second band mounted on a second side which is opposed to the first side of the base plate in a width direction thereof and connected together with the first band, each band having an end with a first hole, which is mounted on the base plate;

a pair of rising portions formed on the first and the second sides of the base plate for fixing the ends of bands, the pair of rising portions having a plurality of second holes each having a hook groove, the hook grooves being formed lengthwise along an inner surface of respective second holes; and a pin adapted to be inserted into one of the plurality of second holes of the rising portions and each first hole of the band, the pin having a cylindrical structure with a smooth outer surface and a projection to be guided into the hook grooves, wherein the pin is prevented from being removed from one of the plurality of second holes with the hook groove by rotation of the pin after the pin is inserted into one of the second holes with the hook groove and each first hole of each band, so that the projection is received and held in place and the corresponding band and rising portion are pivotally joined together about the pin.

* * * * *